United States Patent [19]

Chesters

[11] 4,344,751

[45] Aug. 17, 1982

[54] FLARES

[75] Inventor: David A. Chesters, Walton-on-Thames, England

[73] Assignee: The British Petroleum Company Limited, London, England

[21] Appl. No.: 132,321

[22] Filed: Mar. 19, 1980

[30] Foreign Application Priority Data

Mar. 24, 1979 [GB] United Kingdom ..... 7910430

[51] Int. Cl.[3] ..... F23D 13/20; F23B 5/00

[52] U.S. Cl. ..... 431/202; 431/33

[58] Field of Search ..... 431/202, 33; 110/193

[56] References Cited

U.S. PATENT DOCUMENTS

| | | | |
|---|---|---|---|
| 3,730,673 | 5/1973 | Straitz | 431/202 |
| 3,797,991 | 3/1974 | Straitz | 431/202 |
| 3,810,733 | 5/1974 | Reagan | 431/202 |
| 3,915,622 | 10/1975 | Desty et al. | 431/202 |
| 3,932,111 | 1/1976 | Liknes et al. | 431/202 |
| 3,994,663 | 11/1976 | Reed | 431/202 |
| 4,073,613 | 2/1978 | Desty et al. | 431/202 |
| 4,147,495 | 4/1979 | Straitz | 431/202 |

*Primary Examiner*—Henry C. Yuen

*Attorney, Agent, or Firm*—Morgan, Finnegan, Pine, Foley & Lee

[57] ABSTRACT

Flarestack for disposal of combustible gases having source of flame extinguishing material such as halogenated hydrocarbon connected to the fuel gas supply line at a point upstream of the burner head. The material may be activated remotely to extinguish one or more flare/pilot light systems and is useful for emergency situations. The burner head may be of the Coanda burner type.

8 Claims, 1 Drawing Figure

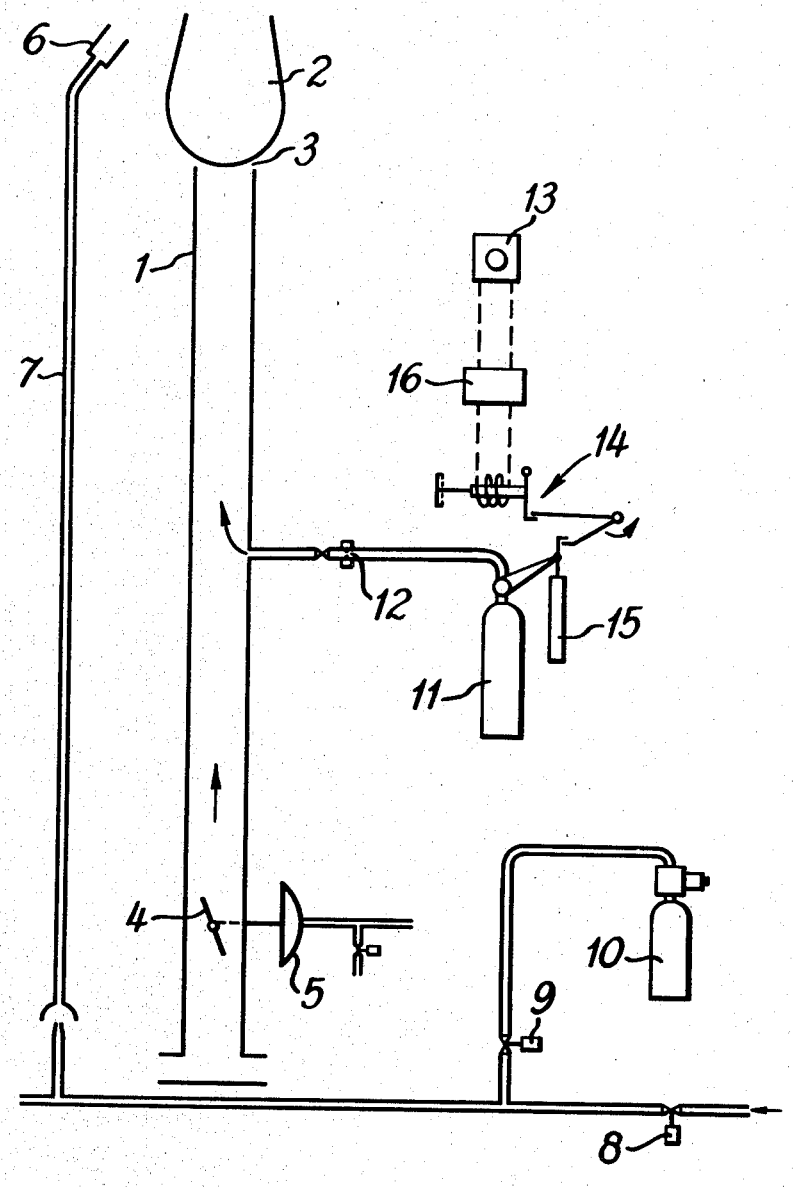
6
2
3
13
1
7
16
14
12
15
11
4
5
10
9
8

FLARES

BACKGROUND OF THE INVENTION

The present invention relates to flares and more paticularly to flare extinguishing systems.

In locations, such as offshore production platform and refineries, employing flare systems for disposing of combustible gases it may be necessary in an emergency to extinguish the flare which otherwise may be a potential hazard. Such emergencies would include a blow out on an oil production platform or fracture of a vessel or line containing inflammable or explosive material. Because of the lengthy burn out time of the gas in the line downstream of the closure valve and often for other reasons, it is not sufficient to merely close off the gas supply. Further, the conventional method of extinguishing flames by directing a flame extinguishing material onto the flame has disadvantages when applied to a flarestack. For example, the pressure drop along the long supply lines to reach the flare tip restricts the available flow rate of material and also it is difficult to cover the flame of a flare in view of its size and wind effects.

SUMMARY OF THE INVENTION

Thus according to the present invention there is provided a flarestack for disposing of combustible gases comprising:

(a) a supply pipe for the combustible gases
(b) a burner head connected to the supply pipe
(c) a pilot light for ignition of the combustible gases at the burner head.
(d) means for supplying a material capable of extinguishing a flame at the burner head and the pilot light comprising a source of said material connectable by means of a valve arrangement to the supply pipe for the combustible gases at a point upstream of the burner head.

The burner head may be that of a pipe flare but is preferably a Coanda body. Suitable types of Coanda burner heads are disclosed in out British Pat. Nos. 1278577, 1383294, 1460576 and application No. 19290/77.

The flame extinguishing material may be carbon dioxide or nitrogen but is preferably a halogenated hydrocarbon and is most preferably bromotrifluoromethane.

The means for supplying the flare extinguishing material to the supply pipe preferably comprises a cylinder of halogenated hydrocarbon connected by a valve and restriction orifice to an inlet in the supply pipe upstream of the burner head. Preferably the material is admitted to the supply pipe by a remote actuation system.

The means for supplying the fire extinguishing material may be connected to one or more flarestack-pilot light systems so as to enable all the stacks to be simultaneously extinguished without risk of reignition.

The invention will now be described by way of example only with reference to the accompanying drawing.

BRIEF DESCRIPTION OF THE DRAWINGS

The drawing shows a schematic diagram of a flare extinguishing system according to the invention.

DESCRIPTION OF THE PREFERRED EMBODIMENT

A Coanda flare stack comprises a vertically disposed fuel gas supply line 1 surmounted by a Coanda body 2 so as to define an annular slot 3 through which fuel gas can pass and then flow over the external surface of the body. The flow of fuel gas along line 1 is regulated by a butterfly valve 4 controlled by a diaphragm 5. The fuel gas supply is not shown but may be, for example, from an off-shore oil production platform or a refinery.

Alongside the flarestack is a pilot light system comprising a pilot light 6 with flame igniter (not shown) and pilot gas supply line 7. The pilot gas supply line 7 contains a solenoid valve 8 downstream of which is a branch line connected via another solenoid valve 9 to a source of nitrogen gas 10.

A side arm in the fuel gas supply line 1 is used to admit a halogenated hydrocarbon. The halogenated hydrocarbon is contained in a cylinder 11 connected via a restriction orifice 12 to line 1. The cylinder valve is connected to a control button 13 activating the flare extinguishing procedure by means of a solenoid triggering system 14 connected to a cylinder valve opening weight 15. Further the diaphragm/butterfly valve 4 system contains a solenoid valve which opens to allow venting of the gas supply line 1 during the emergency shut-down.

During use of the system, on operation of the control button 13, the solenoid triggering system 14 allows the weight 15 to fall and open the valve of cylinder 11. The halogenated hydrocarbon is dispersed via the restriction orifice 12 into the fuel gas flow of line 1 thereby causing extinction of the flame on the flare tip. Simultaneously valve 8 closes and valve 9 opens thereby extinguishing the pilot flame by supplying it with nitrogen.

On an offshore production platform, there may be a number of flarestacks and the control button 13 will then be connected to all the flarestacks, all the stacks being extinguished simultaneously to avoid the risk of reignition of the flares.

On an offshore production platform comprising more than one flarestack, it is desirable to incorporate a timer 16 which enables synchronisation of the various operations required to safely close down the operation of the platform in an emergency. Thus, in a typical series of operations the timer 16 may initiate the following steps (i) closure of the oil supply to the shore storage facilities followed by (ii) closure of the supply valves at the oil well head on the platform. (iii) the platform facilities such as the oil/gas separators are then depressurised through the flare stack for several minutes followed by (iv) the release of cylinders of extinguishing material, e.g. the halogenated hydrocarbon into the flare stacks to put out all the flames on the platform sumultaneously thereby avoiding the risk of reignition.

I claim:

1. An extinguishable flare apparatus for disposing of combustible gases comprising:

(a) a plurality of burner heads,
(b) a supply pipe connected to each burner head for passing combustible gases under pressure to each said burner head,
(c) a pilot light for ignition of the combustible gases at each said burner head,
(d) a supply line connected to each said pilot light for passing pilot gas under pressure to said pilot light,
(e) a source of flame extinguishing material,
(f) connecting means for supplying said flame extinguishing material to the supply pipes and the supply lines and for terminating the flow of pilot gas to the pilot lights, said connecting means comprising a cylinder connected through a valve and a restriction orifice to an inlet in each of said supply pipes, said inlets being upstream from said burner heads, (g) actuating means connected to said connecting means comprising a control apparatus for controlling the operation of a synchronisation means, a triggering apparatus triggered by said synchronisation means, and a switching apparatus controlled by said triggering apparatus for opening said valve;

(h) synchronisation means for controlling the operation of said actuating means so as to delay actuation of said connecting means until said supply pipes are depressurized, and to cause the release of said flame extinguishing material to said supply pipes and supply lines when said connecting means activates so that said flame extinguishing material reaches each of said burner heads and pilot lights simultaneously.

2. An apparatus according to claim 1 wherein said actuating means comprises:

(1) a control button, (2) a solenoid triggering apparatus triggered by said control button, and (3) a weight attached to said solenoid triggering apparatus, said weight opening said valve when it is allowed to drop by said solenoid triggering apparatus.

3. An apparatus according to claims 1 or 2 in which the burner heads are pipe flares.

4. An apparatus according to claims 1 or 2 in which the burner heads are Coanda burners.

5. An apparatus according to claims 1 or 2 in which the flame extinguishing material is a halogenated hydrocarbon.

6. An apparatus according to claims 1 or 2 in which the flame extinguishing material is bromotrifluoromethane.

7. An apparatus according to claims 1 or 2 wherein the flame extinguishing material is carbon dioxide.

8. An apparatus according to claims 1 or 2 wherein the flame extinguishing material is nitrogen.

* * * * *